US006182534B1

(12) United States Patent
Hardman

(10) Patent No.: US 6,182,534 B1
(45) **Date of Patent: *Feb. 6, 2001**

(54) JAR OPENER

(76) Inventor: Herbert S. Hardman, Box 227, River Way East, Milford, NH (US) 03055

( * ) Notice: Under 35 U.S.C. 154(b), the term of this patent shall be extended for 0 days.

This patent is subject to a terminal disclaimer.

(21) Appl. No.: 09/073,289

(22) Filed: May 6, 1998

(51) Int. Cl.[7] ..... B67B 7/00
(52) U.S. Cl. ..... 81/3.2; 81/3.39
(58) Field of Search ..... 81/3.2, 3.36, 3.37, 81/3.39

(56) References Cited

U.S. PATENT DOCUMENTS

| | | |
|---|---|---|
| 1,022,591 | 4/1912 | Perry . |
| 1,702,261 | 2/1929 | Johnson . |
| 1,837,257 | 12/1931 | Eames . |
| 1,856,827 | 5/1932 | Carruthers . |
| 2,005,186 | 6/1935 | Griswold . |
| 2,064,381 | 12/1936 | McColgan . |
| 2,644,354 | 7/1953 | Schlageter . |
| 2,656,084 | 10/1953 | Filander . |
| 2,761,337 | 9/1956 | Daniel . |
| 2,897,699 | 8/1959 | Anderson, Jr. . |
| 3,048,068 | 8/1962 | Griffiths . |
| 3,600,982 | 8/1971 | Tholen . |
| 3,604,290 | 9/1971 | Waite . |
| 3,795,158 | 3/1974 | Morita . |
| 3,919,901 | 11/1975 | Braman . |
| 3,950,801 | 4/1976 | Morrison . |
| 4,102,226 | 7/1978 | McGuire . |
| 4,171,650 | 10/1979 | Cardinal . |
| 4,337,678 | 7/1982 | Mumford . |
| 4,358,970 | 11/1982 | Jacobson . |
| 4,433,597 | 2/1984 | Rowland . |
| 4,455,894 | 6/1984 | Roberts . |
| 4,474,087 | 10/1984 | Widman . |
| 4,519,276 | 5/1985 | Grabarski et al. . |
| 4,569,281 | 2/1986 | Woods . |
| 4,615,241 | 10/1986 | Grabarski et al. . |
| 4,718,312 | 1/1988 | Jones . |
| 4,833,948 | 5/1989 | Jones . |
| 4,852,431 | 8/1989 | Frangel . |
| 4,919,014 | 4/1990 | Chen et al. . |
| 4,926,717 | 5/1990 | Gomes . |
| 5,003,844 | 4/1991 | Barrow . |
| 5,107,727 | 4/1992 | Klefbeck . |
| 5,167,172 | 12/1992 | Heebner . |
| 5,203,236 | 4/1993 | Anderson . |
| 5,207,125 | 5/1993 | Pierce, Jr. et al. . |
| 5,209,142 | 5/1993 | Dickson . |
| 5,271,296 | 12/1993 | Parent et al. . |
| 5,329,831 | 7/1994 | Pierce, Jr. et al. . |
| 5,647,251 | 7/1997 | Hardman . |

*Primary Examiner*—David A. Scherbel
*Assistant Examiner*—Joni B. Danganan
(74) *Attorney, Agent, or Firm*—Fish & Richardson P.C.

(57) ABSTRACT

A fully automatic jar opener for loosening a threaded cap includes a bottom jar retainer including substantially horizontal clamps automatically movable along a horizontal plane between an open position and a jar clamping position. The clamps, while in the jar clamping position, hold a jar substantially without slippage and a top jar retainer holds the cap substantially without slippage when the cap is subjected to a twisting force. A vertical drive automatically adjusts the relative vertical positions between the bottom and top retainers to apply a holding force on the cap. The automatic jar opener includes at least one electrically-controllable pneumatic actuator for moving for moving the clamps along the horizontal plane, and at least one motor for applying the twisting force to the top retainer and for adjusting the relative vertical position between the retainers. A controller automatically controls the pneumatic actuator and the motor and enables loosening of the cap with one single, discrete user command.

26 Claims, 10 Drawing Sheets

JAR OPENER

BACKGROUND OF THE INVENTION

The invention relates to jar openers and more particularly to automatic jar openers.

SUMMARY OF THE INVENTION

The invention relates to a fully automatic jar opener for loosening a threaded jar cap on a jar. The jar opener includes a bottom jar retainer including substantially horizontal clamps that are automatically movable along a horizontal plane between an open position and a jar clamping position. The clamps, while in the jar clamping position, hold the jar substantially without slippage when the jar cap is subjected to a twisting force. A top jar retainer holds the jar cap substantially without slippage when the twisting force is applied to the jar cap. The twisting force is applied to the jar cap by the top jar retainer. A vertical drive automatically adjusts a relative vertical position between the bottom jar retainer and the top jar retainer, the relative vertical position determines a holding force of the top jar retainer on the jar cap for a given jar size. The automatic jar opener includes one or more drivers for moving the clamps along the horizontal plane, for adjusting the relative vertical position between the bottom jar retainer and the top jar retainer, and for applying the twisting force to the top jar retainer. A controller automatically controls the action of the drivers and the movements of the clamps and enables loosening of the jar cap on a jar that has been placed in the opener with a single, discrete user command that is input on a user input device.

In particular embodiments of the invention, one of the drivers is a pneumatic actuator for moving the clamps along the horizontal plane, and one or more electric motors adjust the relative vertical position between the bottom jar retainer and the top jar retainer, and apply the twisting force to the top jar retainer. The controller sends a first control signal to a valve that controls the flow of pressurized fluid into the pneumatic actuator. Pressure changes within the pneumatic actuator activates a piston rod whose movement causes the clamps to move along the horizontal plane.

In particular embodiments of the invention, upon the discrete user command, the controller sends a first command signal to a driver resulting in movement of the clamps to the jar clamping position to hold the jar, whereupon the controller sends a second command signal to a driver resulting in movement of the vertical drive to move together the bottom jar retainer and the top jar retainer to apply the holding force to the jar cap, whereupon the controller sends a third command signal to a driver resulting in the twisting force being applied to the jar cap via the top jar retainer to loosen the jar cap.

The controller further sends a fourth signal to the driver resulting in movement of the vertical drive to separate the bottom jar retainer and the top jar retainer to release the holding force on the jar cap and a fifth signal to a driver resulting in movement of the clamps to the open position to release the jar.

In other embodiments of the invention, the fully automatic jar opener includes at least two motors, a first motor for applying the twisting force to the cap and a second motor for adjusting the relative vertical positions of the bottom and top jar retainers.

In one illustrated embodiment, the fully automatic jar opener includes three motors, a first motor for applying the twisting force to the cap, a second motor for adjusting the bottom jar retainer, and a third motor for adjusting the top jar retainer. Upon the discrete user command, the controller sends a first command signal to the second motor to move the clamps to the jar clamping position to hold the jar and a second command signal to the third motor to move the vertical drive to move together the bottom jar retainer and the top jar retainer to apply the holding force to the jar cap. After the clamps have been moved to the jar clamping position and the holding force has been applied to the jar cap, the controller sends a third command signal to the first motor resulting in the twisting force being applied to the jar cap by the top jar retainer to loosen the jar cap.

In particular embodiments of the invention, the jar includes side walls and a base and the clamps contact the jar on opposite side walls of the jar near the base of the jar. The clamps include gripping pads for contacting the jar and holding the jar substantially without slippage when the jar cap is subjected to the twisting force. The clamps define arcuate shaped jar contacting portions permitting clamping of different radii jars within a given range.

In other embodiments of the invention, the fully automatic jar opener includes a housing defining clamp pivots. The clamps are constructed and arranged to move along a horizontal plane between the open position and the jar clamping position by pivoting about the clamp pivots. The clamps are slidably received on the clamp pivots allowing removal and replacement of the clamps. The clamps include arm portions pivotably connected to the clamp pivots and jar contacting portions slidably received on the arm portions. Each jar contacting portion defines an arcuate shaped inner profile permitting clamping of different radii jars within a given range.

In one illustrated embodiment, the top jar retainer includes a cone for gripping a variety of sizes of jar caps. The cone includes a gripping pad for contacting the jar cap and holding the jar cap substantially without slippage when the twisting force is applied to the jar cap.

In other embodiments of the invention, a switch is activated when a predetermined load is applied to the jar by the clamps and another switch is activated when a predetermined load is applied to the jar cap by the top jar retainer. The jar opener includes a housing defining a chamber for placement of the jar and a door with a third switch activated when the door is closed.

The automatic jar opener of the invention can be used to easily loosen a jar cap with one, single discrete user command. The opener can be used with jars having a variety of heights, owing to the adjustment of the position between the clamps and top jar retainer, and with jars having a variety of diameters owing to the cone shape.

Other advantages and features of the invention will be apparent from the following description of the preferred embodiment and from the claims.

DESCRIPTION OF THE PREFERRED EMBODIMENT

Figure 1:
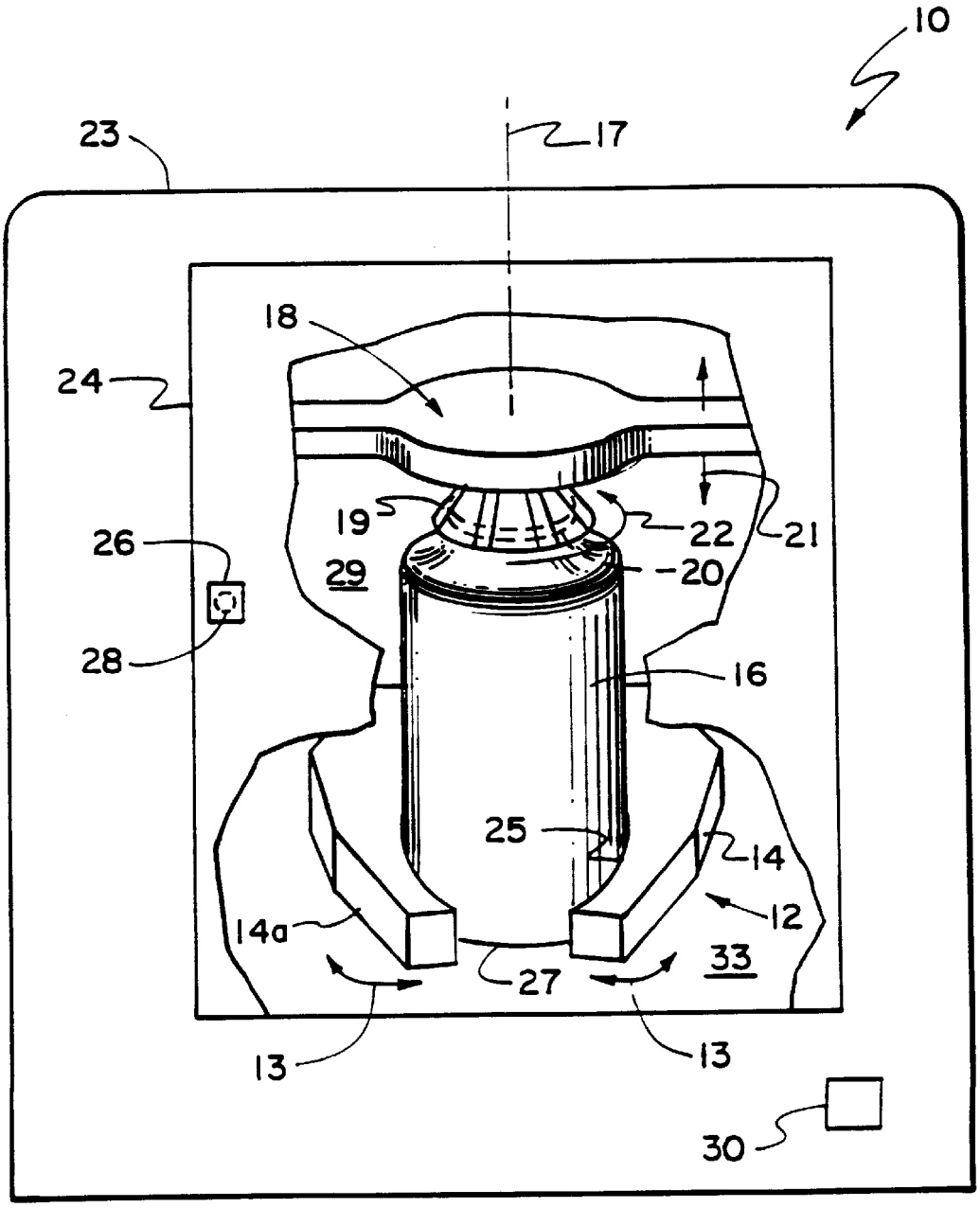
FIG. 1 is a diagrammatic representation of an automatic jar opener according to the invention.

Referring to FIG. 1, an automatic jar opener 10 is shown for automatically loosening a threaded jar cap 20 of a jar 16. A bottom jar retainer 12 for holding jar 16 includes clamps 14, 14*a* mounted for movement (indicated by arrows 13) in a horizontal plane between an open position, FIG. 6, and a jar clamping position, FIG. 1. In the jar clamping position of FIG. 1, clamps 14, 14*a* apply a holding force, for example, 50 to 60 pounds, to side walls 25 of jar 16 near the base 27 of the jar. A top jar retainer 18 is mounted to move vertically (indicated by arrow 21) between an unloaded position, FIG. 6, and a cap loosening position, FIG. 1. In the cap loosening position of FIG. 1, top jar retainer 18 applies a downward holding force, for example, 50 to 60 pounds, to jar cap 20. Top jar retainer 18 also includes a cone 19 mounted to rotate about vertical axis 17 (arrow 22) to apply a twisting force, for example, 10 foot- pound, to jar cap 20 to loosen the cap.

Jar opener housing 23 includes a door 24 allowing access to a jar chamber 29 and platform 33 on which jar 16 is placed by the user. Door 24 includes a safety latch 26 which, upon closing door 24, contacts a switch 28. With door 24 closed, a single user command, for example, activating an input device such as switch 30, instructs automatic jar opener 10 to loosen jar cap 20.

Figure 2:
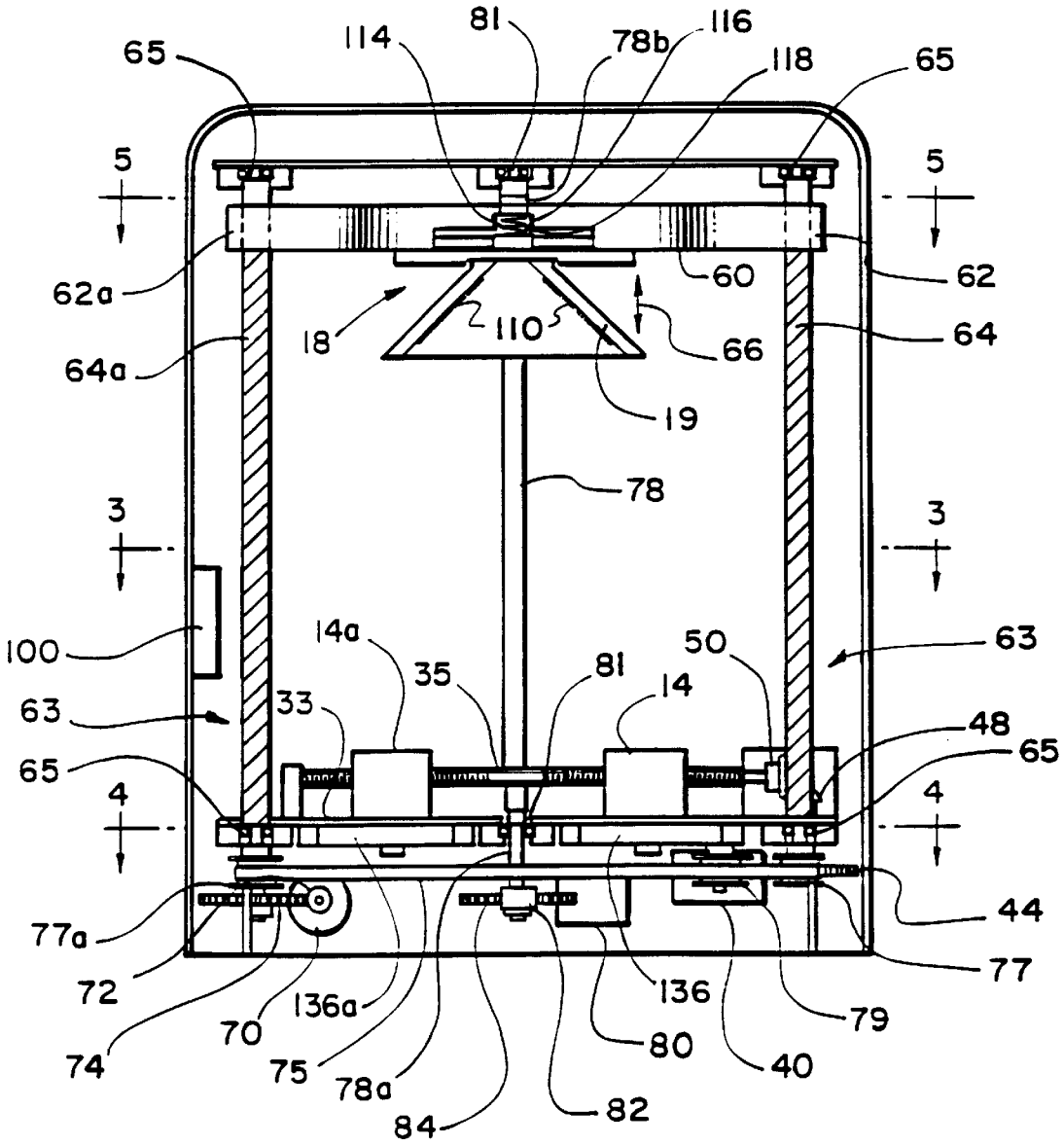
FIG. 2 shows a front view of the automatic jar opener of FIG. 1.
Figure 3:
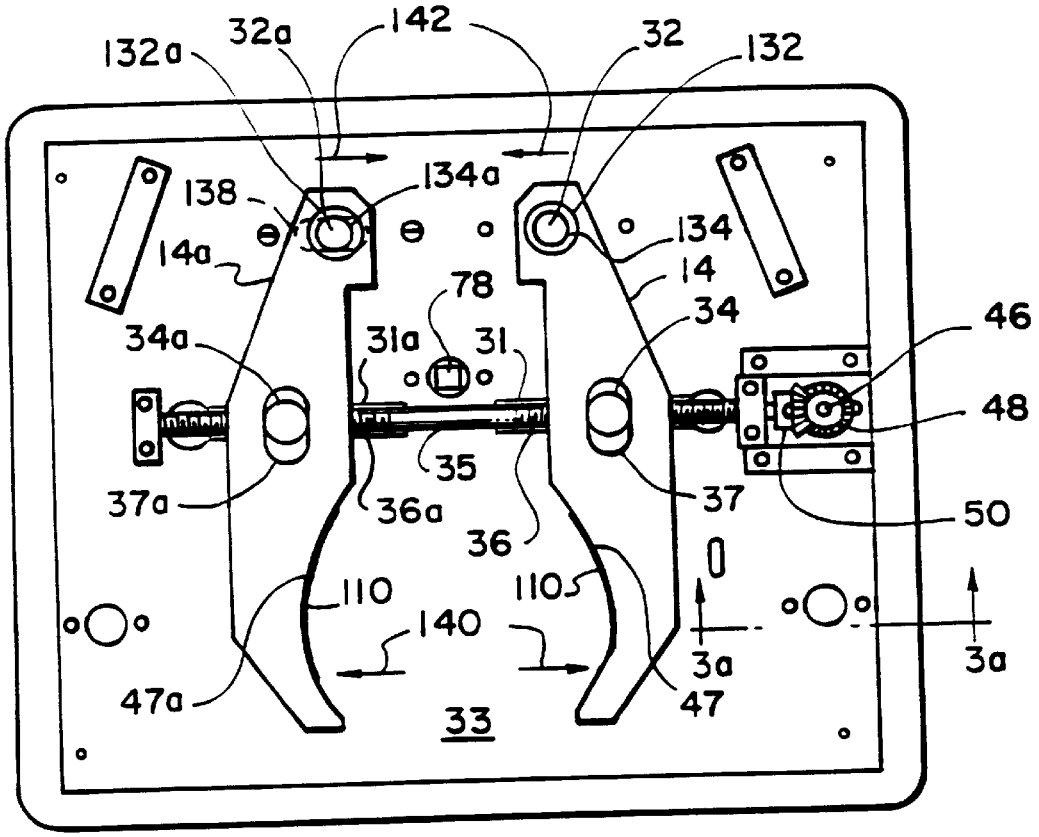
FIG. 3 shows a top view of the automatic jar opener as seen taken along lines 3—3 in FIG. 2.
Figure 4:
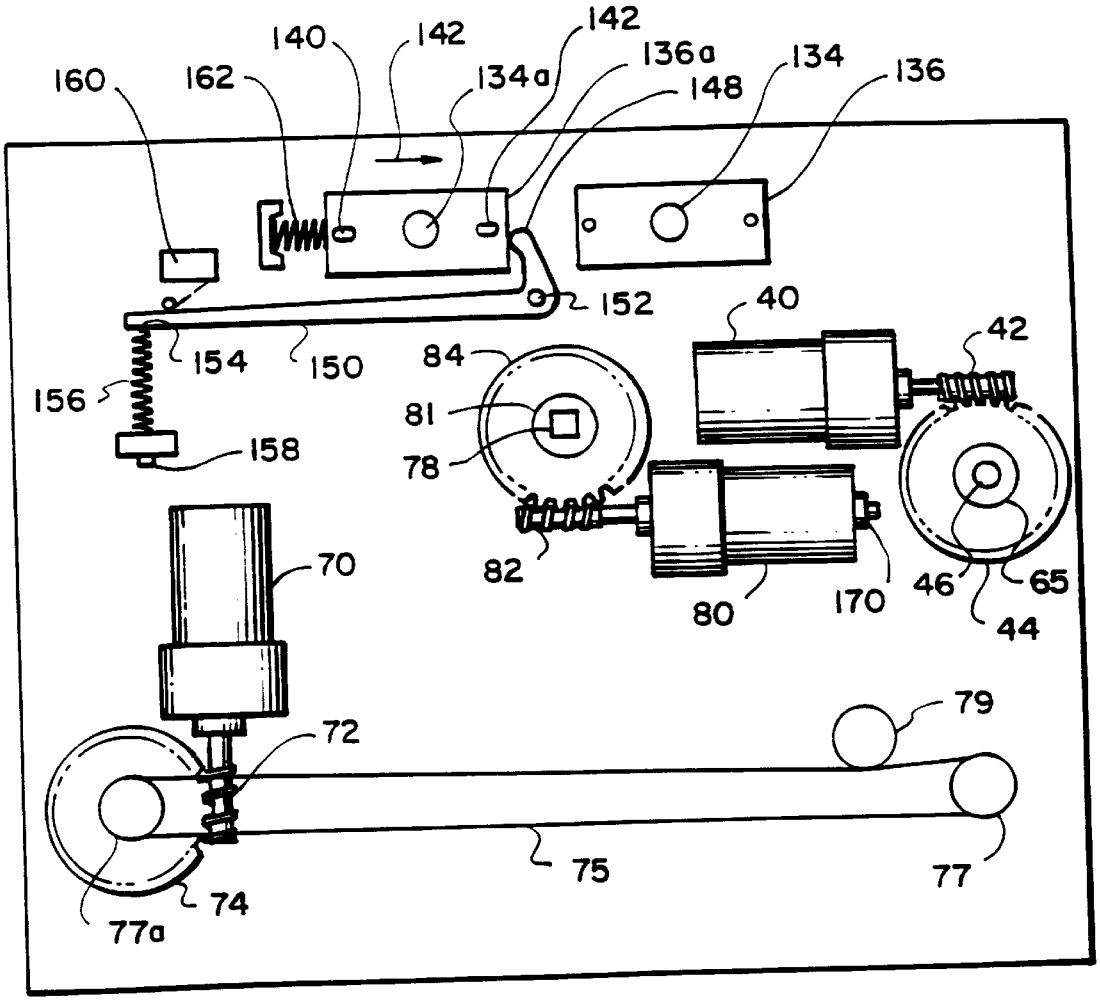
FIG. 4 shows a top view of the automatic jar opener as seen taken along lines 4—4 in FIG. 2.
Figure 6:
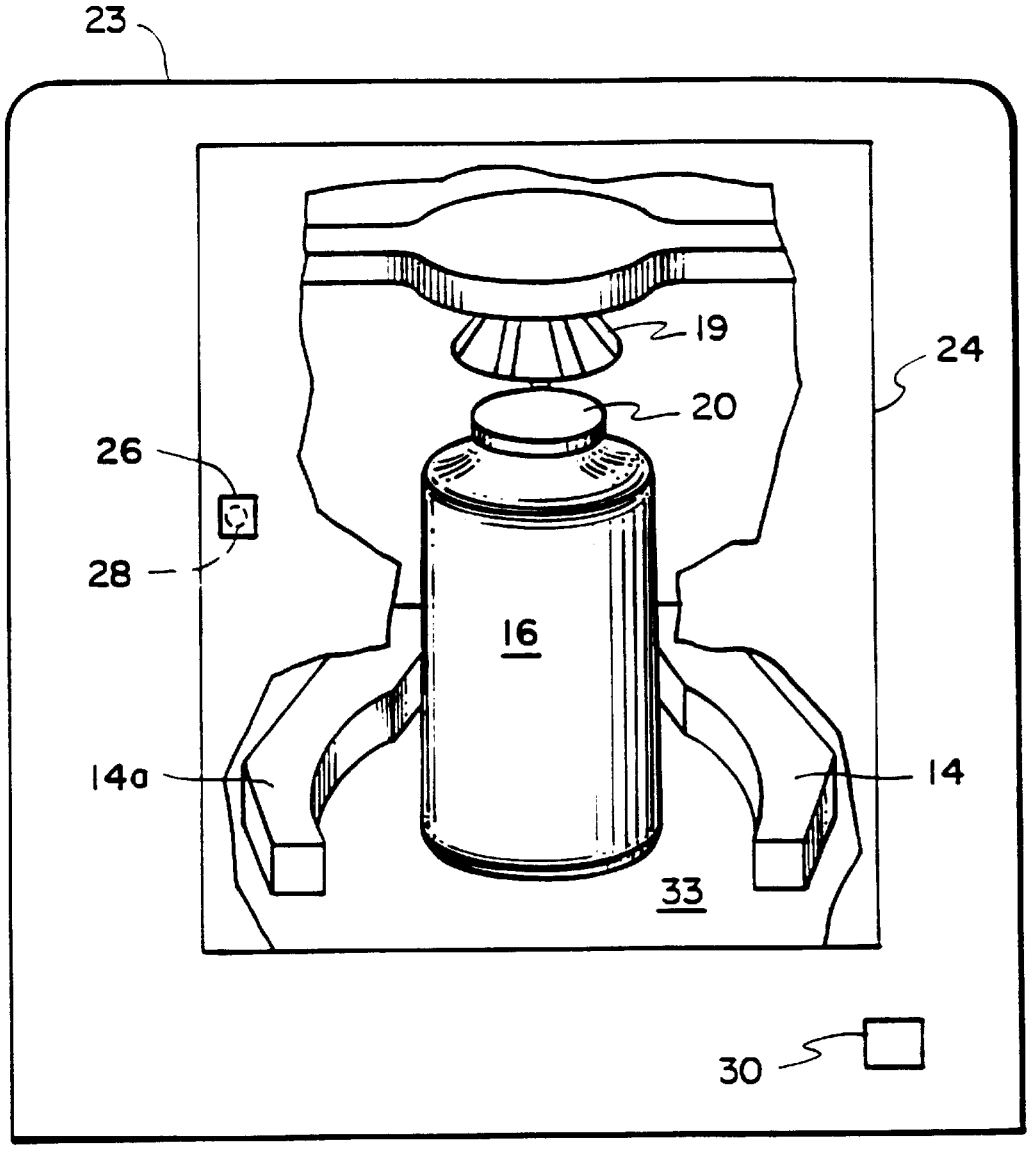
FIG. 6 is a diagrammatic representation of some components of the automatic jar opener shown in a jar receiving position.

Referring to FIGS. 2–4, clamps 14, 14*a* are mounted for movement along a rod 35 between the open position of FIG. 6 and the jar clamping position of FIG. 1. Referring particularly to FIG. 3, clamps 14, 14*a* include slots 37, 37*a* containing threaded elements 34, 34*a* which are mounted on threaded rod ends 36, 36*a* of rod 35. Rod ends 36, 36*a* are oppositely threaded such that rotation of rod 35 causes threaded elements 34, 34*a* to move toward or away from each other along guiding slots 31, 31*a* in a platform 33.

Clamps 14, 14*a* are mounted to rotate about pivots 32, 32*a*. Pivots 32, 32*a* are defined by clamps through bores 132, 132*a* received on extension rods 134, 134*a* of blocks 136, 136*a* (FIG. 2). During movement of clamps 14, 14*a* along rod 35 and about pivots 32, 32*a*, threaded elements 34, 34*a* slide within clamp slots 37, 37*a*. The arcuate shape of jar contacting portions 47, 47*a* of clamps 14, 14*a* permit clamping of different radii jars within a range. Additionally, clamps 14, 14*a* may be slidably received on threaded elements 34, 34*a* and extension rods 134, 134*a* to permit easy replacement of the clamps to accommodate different ranges of sizes for jars 16.

Figure 3A:
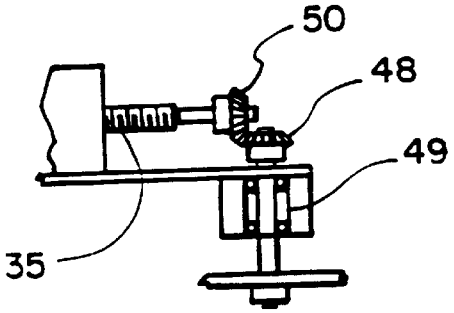
FIG. 3*a* shows a side view of a gear train of the automatic jar opener as seen taken along lines 3*a*–3*a* in FIG. 3.

Referring particularly to FIGS. 3*a* and 4, to rotate rod 35, a motor 40 with worm gear 42 drives a gear 44. Axle 46 of gear 44 drives a helical gear 48 (supported by bearing 49) which in turn drives a helical gear 50 attached to rod 35.

Referring to FIGS. 2 and 4, top jar retainer 18 includes a mount 60 with threaded holes 62, 62*a* received on lead screws 64, 64*a* of a vertical drive 63. Lead screws 64, 64*a* are mounted for rotation within bearings 65 to move top jar retainer 18 vertically (indicated by arrow 66) between the unloaded position of FIG. 6 and the cap loosening position of FIG. 1. To rotate lead screws 64, 64*a*, a motor 70 with worm gear 72 drives a gear 74 attached to lead screw 64*a*. A belt 75 mounted on pulleys 77, 77*a* couples motion of lead screw 64*a* to lead screw 64. Idler 79 keeps belt 75 under tension.

Figure 5:
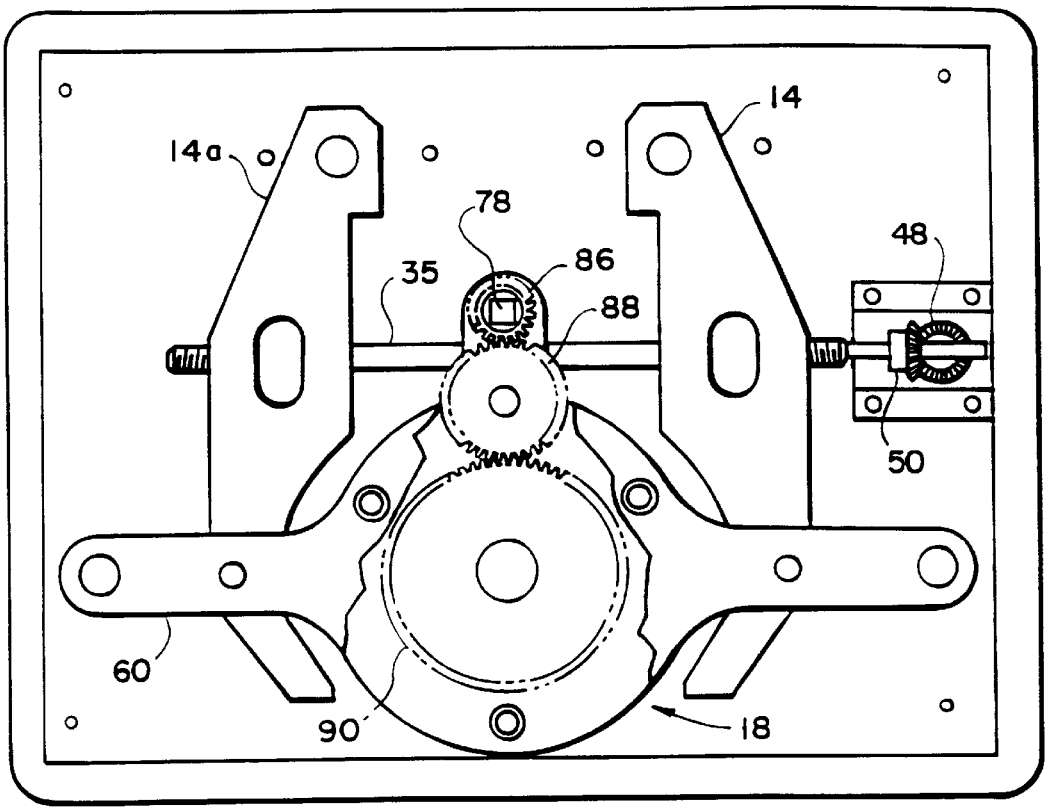
FIG. 5 shows a partially cut away top view of the automatic jar opener as seen taken along lines 5—5 in FIG. 2.

Referring to FIGS. 2, 4 and 5, mount 60 of top jar retainer 18 is received on a square rod 78 for rotation therewith. To rotate cone 19, a motor 80 with worm gear 82 drives a gear 84 attached at one end 78*a* of square rod 78. At the opposite end 78*b* of square rod 78 is a gear drive including gears 86, 88 and 90. Gear 90 is mounted to cone 19 for rotation therewith.

Referring to FIG. 3, clamps 14, 14*a* include non-slip surfaces 110, for example, a rubberized foam such as that found on the backing of place mats or scatter rugs, to hold the jar substantially without slippage when the jar cap is subjected to the twisting force. As shown in FIG. 2, cone 19 also includes a non-slip surface 110, which, when combined with the holding force applied by top jar retainer 18 on jar cap 20, holds jar cap 20 substantially without slippage when the twisting force is applied to the jar cap. The inclined shape of cone 19 permits engagement between surface 110 and a variety of different sized caps.

Referring to FIGS. 3 and 4, in the illustrated embodiment, when clamps 14, 14*a* contact jar 16 and apply the holding force to the jar, an opposite force directed along arrows 140 is applied to the clamps and a related force directed along arrows 142 is applied by the clamps to rods 134, 134*a*. A slot 138 in platform 33 and slots 140, 142 in block 136*a* allow clamp 14*a* and block 136*a* to move in the direction of arrow 142 in response to this force. Block 136*a* abuts a first end 148 of a lever 150. Movement of block 136*a* causes rotation of lever 150 about a pivot 152. A second end 154 of lever 150 is attached to an extension spring 156. Rotation of lever 150 acts against extension spring 156. Extension spring 156 is set, for example, by turning an adjustment screw 158, such that rotation of lever 150 about pivot 152 an amount necessary to activate a limit switch 160 corresponds to the desired clamp load on jar 16. A compression spring 162 acts on block 136*a* against extension spring 156 such that block 136*a* is not free- floating within slots 138, 140 and 142 when clamps 14, 14*a* are in their open position.

Referring to FIG. 2, cone 19 includes a spring 114 located within a recess 116 in housing 60. A switch 118 located within recess 116 is activated when the spring has been depressed a predetermined distance corresponding to the desired vertical load. Motor 80 includes a potentiometer 170 for measuring the rotation of cone 19. The cone is generally rotated about one-half turn to loosen cap 20.

Automatic jar opener 10 includes a controller 100 for automatically controlling motors 40, 70 and 80. Triggering of switch 160 sends a signals to controller 100 indicating that the desired clamp force of clamps 14, 14*a* on jar 16 has been reached. Controller 100 then commands motor 40 to hold this position. Similarly, triggering of switch 118 sends a signal to controller 100 indicating that the desired vertical load of cone 19 on jar 16 has been reached. Controller 100 then commands motor 70 to hold this position. Controller 100 monitors potentiometer 170 during rotation of cone 19 and stops rotation of motor 80 when the cap has been turned about one-half turn.

Referring to FIG. 6, in use, jar 16 is placed between open clamps 14, 14*a*. Door 24 is closed with safety latch 26 contacting switch 28. The user then pushes switch 30 sending a signal to controller 100 to loosen jar cap 20. From this point, jar opener 10 is under automatic control. Controller 100 sends signals to motors 40 and 70 resulting in the closing of clamps 14, 14*a* and the lowering of cone 19. When the desired loads of clamps 14, 14*a* and cone 19 on jar 16 has been reached, as determined by monitoring switches 160 and 118, respectively, controller 100 sends a signal to motor 80 to turn cone 19 one-half-turn. Controller 100 then directs motors 40 and 70 to open clamps 14, 14*a* and lift cone 19. Door 24 can then be opened. If door 24 is opened before completion of the cap loosening cycle, as determined by monitoring door sensor 28, controller 100 stops all movement.

Other embodiments of the invention are within the scope of the following claims.

For example, controller 100 can monitor the current draw of motors 40 and 70, as is well known in the art, to determine and maintain the desired loads on jar 16. Alternatively, motors 40 and 70 can include slip clutches designed to apply only the desired loads to jar 16. The three motors 40, 70 and 80 can be replaced with one or two motors and appropriate drive linkages.

Cone 19 can include a serrated inner lining to aid in gripping jar cap 20.

Figure 7:
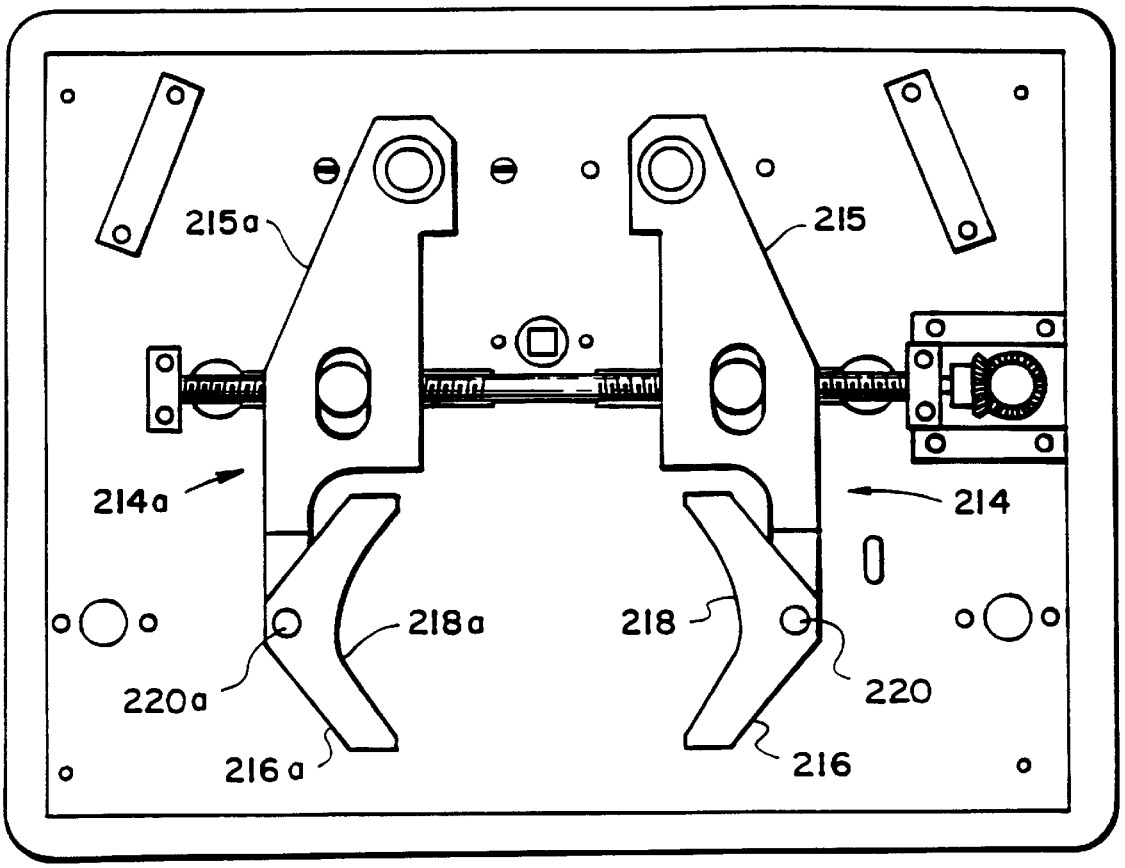
FIG. 7 shows an alternative embodiment of the jar clamps of the invention.

Referring to FIG. 7, clamps 214, 214*a* include arms 215, 215*a* and jar contacting portions 216, 216*a*. The inner arcuate shaped profiles 218, 218*a* of jar contacting portions 216, 216*a* permit clamping of a variety of sized jars. Jar contacting portions 216, 216*a* may be slidably received on rods 220, 220*a* of clamps 214, 214*a* for ease of replacement.

Figure 8A:
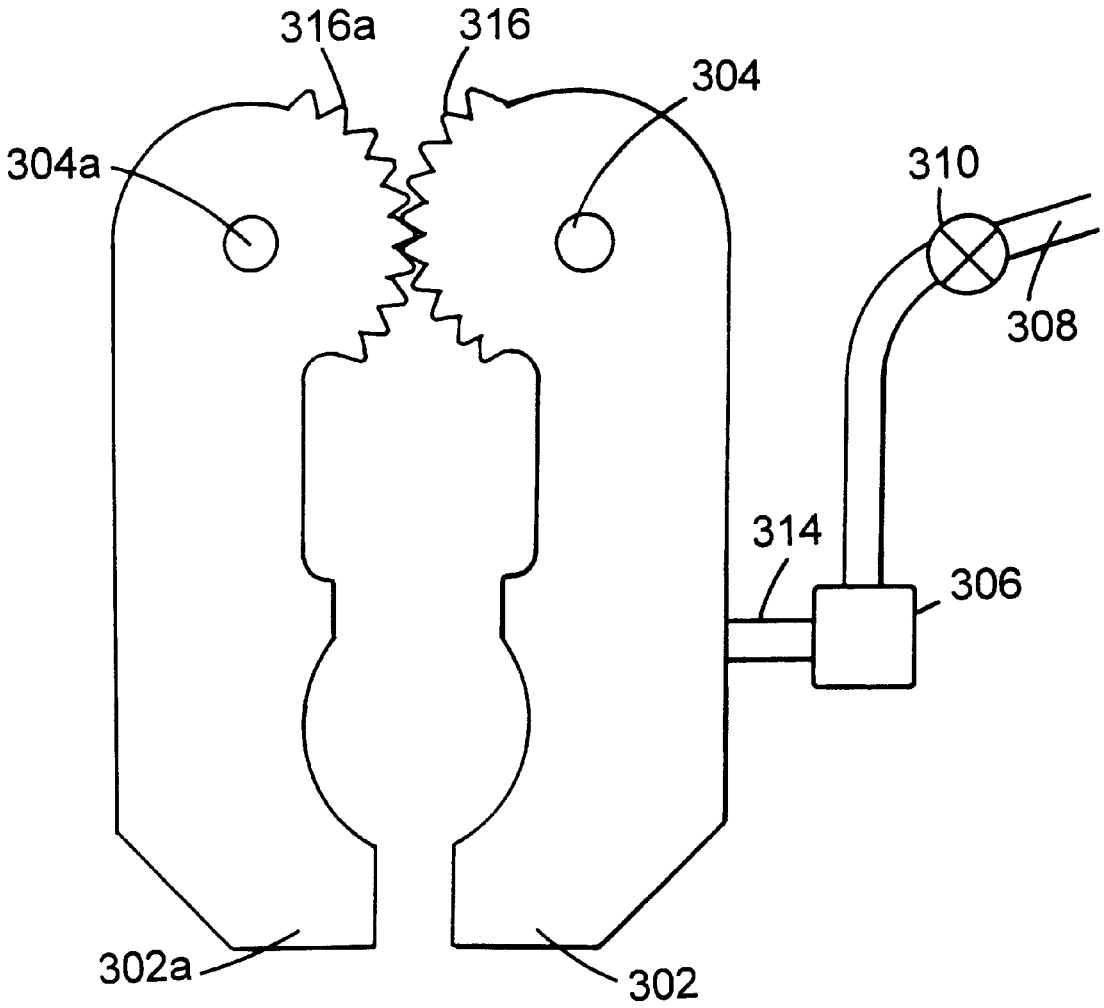
FIG. 8*a* is a diagrammatic representation of an alternative embodiment of the jar clamps of the invention.
Figure 8B:
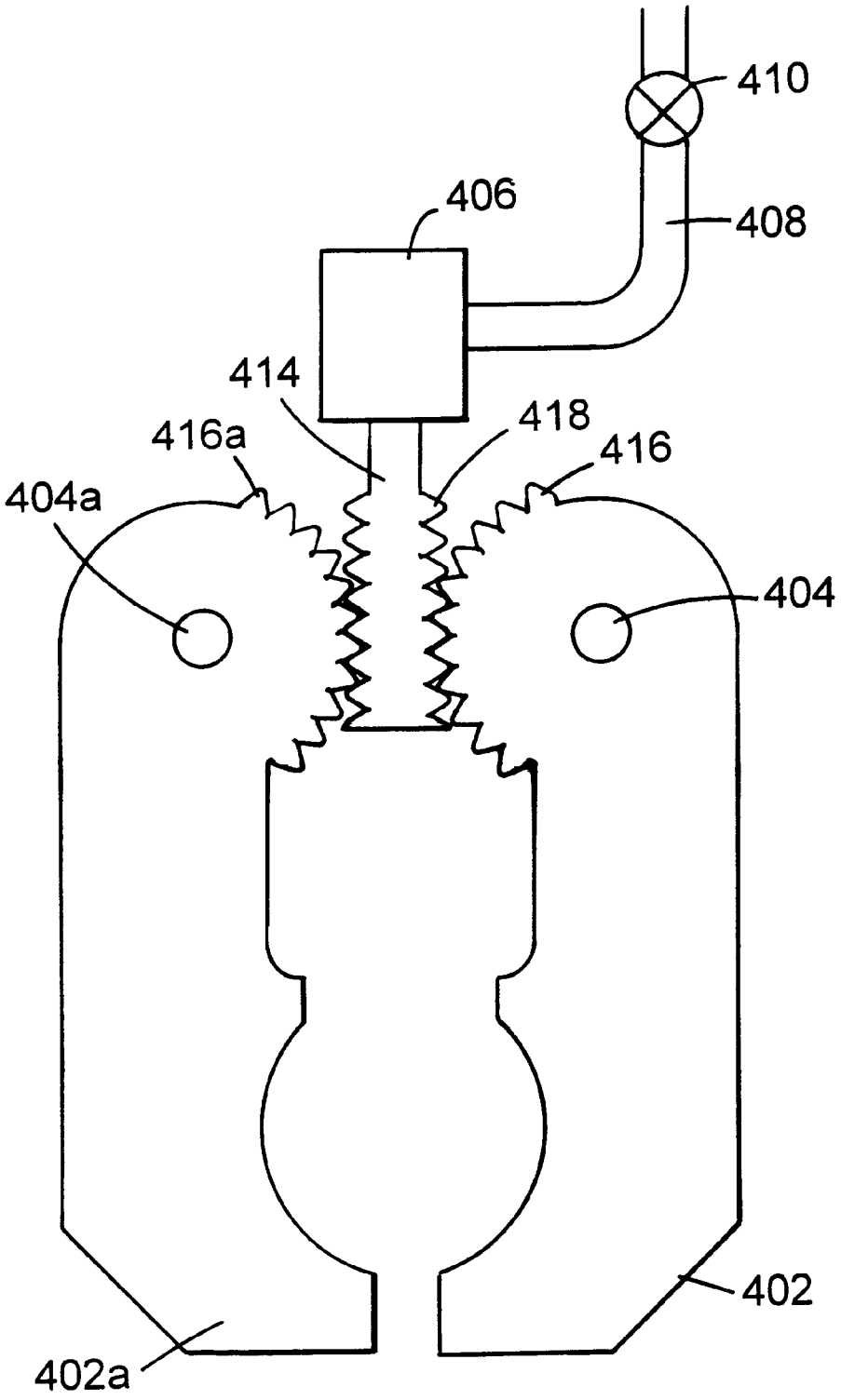
FIG. 8*b* is a diagrammatic representation of another alternative embodiment of the jar clamps of the invention.
Figure 8C:
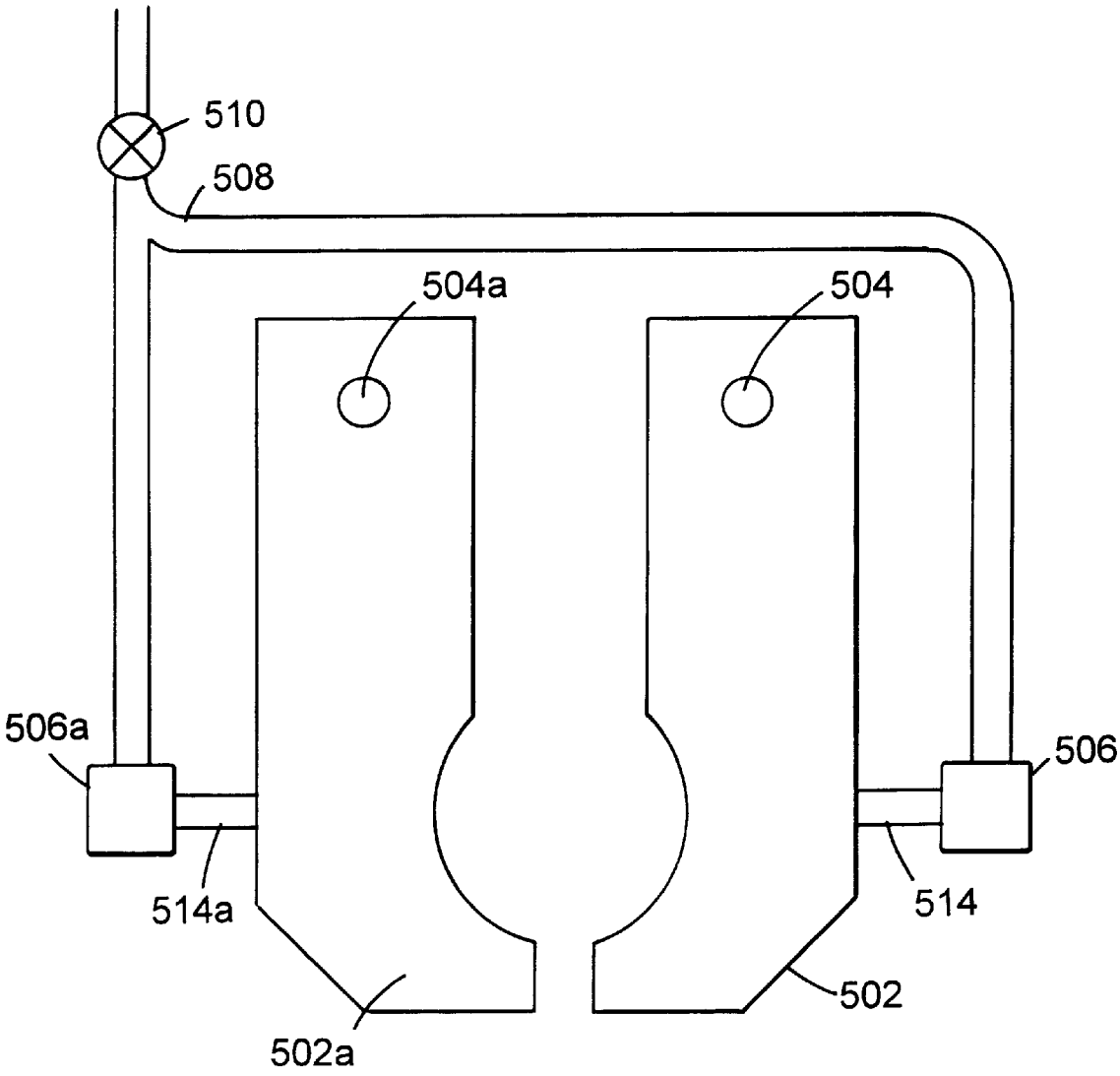
FIG. 8*c* is a diagrammatic representation of still another alternative embodiment of the jar clamps of the invention.

Referring to FIGS. 8*a*–8*c*, clamps 302 and 302*a*, 402 and 402*a*, and 502 and 502*a* are mounted to rotate about pivots 304 and 304*a*, 404 and 404*a*, and 504 and 504*a*, respectively. Pneumatic actuators 306, 406, and 506 and 506*a* are connected to respective fluid supply tubes 308, 408, and 508 for the delivery of pressurized fluid. Solenoid valves 310, 410, and 510 are joined to and interrupt tubes 308, 408, and 508 and are controlled by electronic controller 100. Piston rods 314, 414, and 514 and 514*a* project slidably from pneumatic actuators 306, 406, and 506 and 506*a*, respectively.

In FIG. 8*a*, clamps 302 and 302*a* contain sets of engaging teeth 316 and 316*a* that mesh with each other so that the movement of one of clamps 302 or 302*a* causes a reciprocal movement by the other one. Piston rod 314 is connected to clamp 302.

In FIG. 8*b*, piston rod 414 has teeth 418 that mesh with engaging teeth 416 and 416*a* on clamps 402 and 402*a*, respectively.

In FIG. 8*c*, fluid supply tube 508 is capable of delivering pressurized fluid to both pneumatic actuators 506 and 506*a*. Piston rods 514 and 514*a* are connected to clamps 502 and 502*a*, respectively.

Actuators 306, 406, 506, and 506*a* have spring returns. Alternatively, the actuators could be driven in both directions by providing additional solenoid valves and providing two controlled pneumatic supplies to the actuators.

What is claimed is:

1. A fully automatic jar opener for loosening a threaded jar cap on a jar including sidewalls and a base, comprising:

a bottom jar retainer including substantially horizontal clamps, said clamps being automatically movable along a horizontal plane between an open position and a jar clamping position, said bottom jar retainer including a means for establishing a predetermined sidewall holding force on said sidewalls and said clamping position, sufficient to hold the jar substantially without slippage when the jar cap is subjected to a twisting force, a top jar retainer for holding the jar cap substantially without slippage when said twisting force is applied to the jar cap, said twisting force being applied to the jar cap via said top jar retainer, a vertical drive for automatically adjusting a relative vertical position between said bottom jar retainer and said top jar retainer, said relative vertical position determining a holding force of said top jar retainer on said jar cap, one or more electrically-controlled drivers for causing the movement of said clamps along the horizontal plane to said clamping position for achieving said sidewall holding force, for applying said twisting force to said top jar retainer and for adjusting the relative vertical position between said bottom jar retainer and said top jar retainer, a controller for automatically controlling said one or more drivers, said controller enabling loosening of the jar cap with one single, discrete user command, and a user input device for inputting said single, discrete user command, wherein said one or more electrically-controlled drivers includes a pneumatic actuator.

2. The opener of claim 1 wherein said pneumatic actuator causes the movement of said clamps along the horizontal plane.

3. The opener of claim 2 wherein said one or more drivers include one or more motors for applying said twisting force to said top jar retainer and for adjusting the relative vertical position between said bottom jar retainer and said top jar retainer.

4. The fully automatic jar opener of claim 3 wherein, upon said discrete user command, said controller sends a first command signal to said one or more pneumatic actuators resulting in movement of said clamps to said jar clamping position to hold the jar, whereupon said controller sends a second command signal to said one or more motors resulting in movement of said vertical drive to move together said bottom jar retainer and said top jar retainer to apply said holding force to the jar cap, whereupon said controller sends a third command signal to said one or more motors resulting in said twisting force being applied to the jar cap via said top jar retainer to loosen the jar cap.

5. The fully automatic jar opener of claim 4 further including said controller sending a fourth signal to said one or more motors resulting in movement of said vertical drive to separate said bottom jar retainer and said top jar retainer to release said holding force on the jar cap.

6. The fully automatic jar opener of claim 5 further including said controller sending a fifth signal to said one or more motors resulting in movement of said clamps to said open position to release the jar.

7. The fully automatic jar opener of claim 3 wherein there are at least two motors, including a first motor for applying said twisting force to the jar cap and a second motor for adjusting said bottom and top jar retainers.

8. The fully automatic jar opener of claim 3 wherein, upon said discrete user command, said controller sends a first command signal to control said pneumatic actuator to move said clamps to said jar clamping position to hold said jar and a second command signal to a said motor to move said vertical drive to move together said bottom jar retainer and said top jar retainer to apply said holding force to the jar cap, whereupon, after said clamps have been moved to said jar clamping position and said holding force has been applied to the jar cap, said controller sends a third command signal to a said motor resulting in said twisting force being applied to the jar cap via said top jar retainer to loosen the jar cap.

9. The opener of claim 1 wherein said one or more drivers include one or more motors for applying said twisting force to said top jar retainer and for adjusting the relative vertical position between said bottom jar retainer and said top jar retainer.

10. The fully automatic jar opener of claim 1 wherein said clamps contact the jar on opposite side walls of the jar near the base of the jar.

11. The fully automatic jar opener of claim 10 wherein said clamps include gripping pads for contacting the jar and holding the jar substantially without slippage when the jar cap is subjected to said twisting force.

12. The fully automatic jar opener of claim 1 wherein said clamps define arcuate shaped jar contacting portions permitting clamping of different radii jars within a given range.

13. The fully automatic jar opener of claim 1 further including a housing defining clamp pivots, said clamps being constructed and arranged to move along the horizontal plane between said open position and said jar clamping position by pivoting about said clamp pivots.

14. The fully automatic jar opener of claim 13 wherein said clamps are slidably received on said clamp pivots allowing removal and replacement of said clamps.

15. The fully automatic jar opener of claim 13 wherein said clamps include arm portions pivotably connected to said clamp pivots and jar contacting portions slidably received on said arm portions.

16. The fully automatic jar opener of claim 15 wherein each said jar contacting portion define an arcuate shaped inner profile permitting clamping of different radii jars within a given range.

17. The fully automatic jar opener of claim 1 wherein said top jar retainer includes a cone for gripping a variety of sizes of jar caps.

18. The fully automatic jar opener of claim 17 wherein said cone includes a gripping pad for contacting the jar cap and holding the jar cap substantially without slippage when said twisting force is applied to the jar cap.

19. The fully automatic jar opener of claim 1 further including a switch activated when a predetermined load is applied to the jar by said clamps.

20. The fully automatic jar opener of claim 1 further including a switch activated when a predetermined load is applied to the jar cap by said top jar retainer.

21. The fully automatic jar opener of claim 1 further including a housing defining a chamber for placement of the jar.

22. The fully automatic jar opener of claim 21 wherein said housing further includes a door and a switch activated when said door is closed.

23. the A fully automatic jar opener for loosening a threaded jar cap on a jar including sidewalls and a base, comprising:

a bottom jar retainer including substantially horizontal clamps, said clamps being automatically movable along a horizontal plane between an open position and ajar clamping position, said bottom jar retainer including a means for establishing a predetermined holding force on said sidewalls and said clamping position, sufficient to hold the jar substantially without slippage when the jar cap is subjected to a twisting force, a top jar retainer for holding the jar cap substantially without slippage when said twisting force is applied to the jar cap, said twisting force being applied to the jar cap via said top jar retainer, a vertical drive for automatically adjusting a relative vertical position between said bottom jar retainer and said top jar retainer, said relative vertical position determining a holding force of said top jar retainer on said jar cap, one or more electrically-controllable pneumatic actuators capable of causing the movement of said clamps along the horizontal plane to said clamping position for achieving said sidewalls holding force, one or more motors for applying said twisting force to said top jar retainer and for adjusting the relative vertical position between said bottom jar retainer and said top jar retainer, and a controller for automatically controlling said one or more motors.

24. The fully automatic jar opener of claim 23 wherein said clamps include gripping pads for contacting the jar and holding the jar substantially without slippage when the jar cap is subjected to said twisting force.

25. The fully automatic jar opener of claim 23 wherein said clamps define arcuate shaped jar contacting portions permitting clamping of different radii jars within a given range.

26. The fully automatic jar opener of claim 23 further including a housing defining clamp pivots, said clamps being constructed and arranged to move along the horizontal plane between said open position and said jar clamping position by pivoting about said clamp pivots.

* * * * *

UNITED STATES PATENT AND TRADEMARK OFFICE

CERTIFICATE OF CORRECTION

PATENT NO. : 6,182,534 B1
DATED : February 6, 2001
INVENTOR(S) : Herbert S. Hardman It is certified that error appears in the above-identified patent and that said Letters Patent is hereby corrected as shown below:

Title page,
Item [57], ABSTRACT,
Line 12, remove "for moving"

Column 4,
Line 58, change "signals" to -- signal --

Column 8,
Line 7, delete "the" before "A"
Line 13, change "ajar" to -- a jar --

Signed and Sealed this

Fifth Day of August, 2003

JAMES E. ROGAN
*Director of the United States Patent and Trademark Office*